United States Patent [19]

Ericson et al.

[11] 3,976,224

[45] Aug. 24, 1976

[54] COLLAPSIBLE DISPENSING TUBES

[75] Inventors: Kenneth R. Ericson; Ernest S. Smith, both of Cincinnati, Ohio

[73] Assignee: The Procter & Gamble Company, Cincinnati, Ohio

[22] Filed: Nov. 1, 1974

[21] Appl. No.: 520,088

Related U.S. Application Data

[63] Continuation of Ser. No. 216,500, Jan. 10, 1972, abandoned.

[52] U.S. Cl. ..... 222/107; 428/213; 428/461

[51] Int. Cl.[2] ..... B65D 35/08

[58] Field of Search ..... 222/107, 215, 92; 161/216, 252, 247; 138/138, 143; 428/213, 461, 463

[56] References Cited

UNITED STATES PATENTS 2,817,124 12/1957 Dybvig ..... 161/216 X 3,505,143 4/1970 Haas et al. ..... 222/107 X

OTHER PUBLICATIONS

"Glossary of Packaging Terms", Packaging Institute, Inc., 1967, pp. 4–5.

*Primary Examiner*—Robert B. Reeves
*Assistant Examiner*—Joseph J. Rolla
*Attorney, Agent, or Firm*—Elliot A. Lackenbach; John V. Gorman; Richard C. Witte

[57] ABSTRACT

A collapsible dispensing tube is formed from a laminate which includes two separate layers of metallic foil; e.g., aluminum. This configuration allows substantially independent variation of the deadfold (i.e., tendency of the tube to stay in the rolled-up position) and body (i.e., tendency of the tube to resist being rolled-up) of such a tube. Species of the invention having both desirable deadfold and desirable body are disclosed.

15 Claims, 12 Drawing Figures

0 DEADFOLD

1 DEADFOLD

2 DEADFOLD

3 DEADFOLD

4 DEADFOLD

5 DEADFOLD

6 DEADFOLD

COLLAPSIBLE DISPENSING TUBES

This is a continuation of application Ser. No. 216,500, filed Jan. 10, 1972.

BACKGROUND OF THE INVENTION

This invention relates to laminated collapsible dispensing tubes and in particular such tubes formed from a laminate which includes two separate layers of metallic foil.

Until recently the majority of commercially used collapsible dispensing tubes have been constructed of lead and other similar materials. Lead in particular has a unique combination of characteristics making it well suited for use in such a tube. It is reasonably rigid thereby affording protection to the product contained in a tube formed of it while being deformable enough to allow it to be rolled-up. In addition lead has an extremely low yield point and consequently will stay in the rolled-up position.

Two of the major characteristics used in describing collapsible dispensing tubes is their "body" which is the feeling of substantialness of the tube and which can best be measured by the force required to roll up the tube and the "deadfold" of the tube which is its tendency to remain in the rolled-up position. As mentioned previously, lead tubes have both good body and good deadfold and the consumer's familiarity with them has made them the standard against which other tubes are measured in respect to these properties.

Lead tubes have certain disadvantages such as their tendency to crack and their requirement for coating them to make them compatible with certain products which they may contain. Consequently there has been a continuing search for acceptable substitutes for lead tubes.

Various polymers, i.e. plastic materials, were considered as possible replacements for lead tubes. Plastic materials however do not have the required low yield point to give the tube an appropriate degree of deadfold. In addition, plastic materials are not impervious to oxygen and water vapor transmission thereby making them unacceptable for packaging many commercial products, e.g. toothpaste.

Various laminate structures have therefore been tried as a substitute for lead tubes. In the design of such laminate structures each layer of material has generally been considered as a means for accomplishing a single purpose, for example, a single layer of metallic foil is frequently used as the main structural unit of the tube. Additional layers of material have then been added to provide various barrier properties or to provide an appropriate surface on which printing can be done. Similarly, other materials each performing a single function are added to form an overall laminate structure some of which have had as many as eight separate layers.

As the result of the approach of considering each layer of a laminate tube separately as the prior art does, such tubes have heretofore had a number of inherent compromises principally as a result of inability to independently vary deadfold and body.

It has been found that a laminate structure containing two layers of metallic foil permits variation in deadfold and body properties substantially independently of one another and therefore allows the production of a collapsible dispensing tube with both desirable deadfold and body properties. In addition, the tube of this invention has the ability to achieve both of these results while using reduced amounts of the relatively expensive metallic foil.

OBJECTS AND SUMMARY OF THE INVENTION

Accordingly it is an object of this invention to provide a laminate collapsible dispensing tube having good body and deadfold properties such as those of lead tubes.

It is a further object of this invention to produce such a structure while using reduced amounts of metallic foil.

It is a further object of this invention to produce such a structure which may be easily constructed by conventional techniques.

These and other objects are achieved in a collapsible dispensing tube including a headpiece having a dispensing orifice therein and a body extending from said headpiece said body being formed from a laminated material comprising an inner layer of polymer, a first layer of metallic foil superposed thereover and bonded thereto, a second layer of polymer superposed on said first layer of metallic foil and bonded thereto, a second layer of metallic foil superposed over said second layer of polymer and bonded thereto, said laminated material being formed into a tubular body by wrapping the laminated material through a single turn such that the longitudinal edges thereof are placed in contiguous relationship and forming a longitudinal seam in the area of said edges. As used herein, "polymer" is understood to include "copolymer".

BRIEF DESCRIPTION OF THE DRAWINGS

Although the specification concludes with claims particularly pointing out and distinctly claiming the subject matter regarded as forming the present invention, it is believed that the invention will be better understood from the following description taken in connection with the accompanying drawings in which:

DESCRIPTION OF THE PREFERRED EMBODIMENTS

Figure 1:
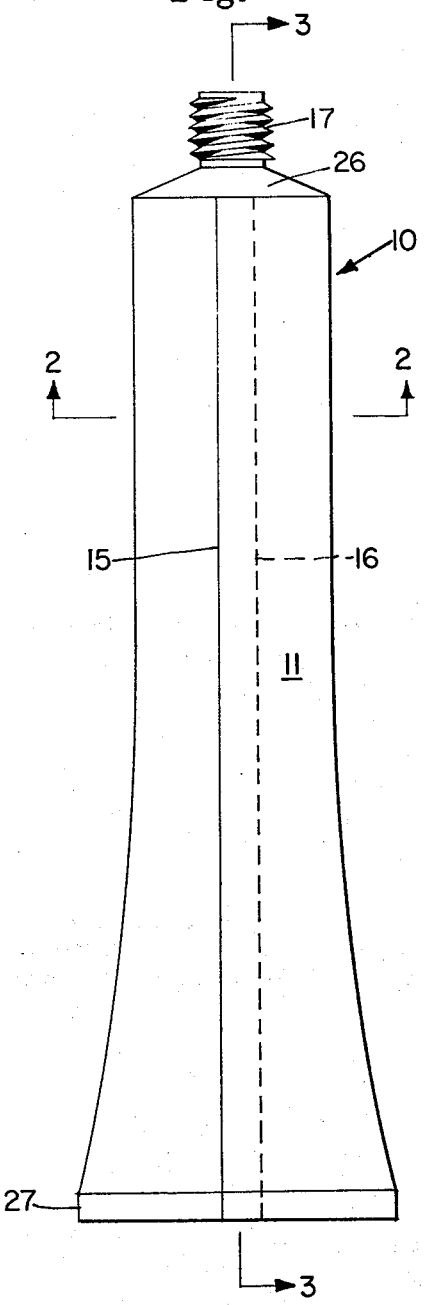
FIG. 1 is an elevation view of a preferred embodiment of the tube of this invention.

Referring now to the drawings, FIG. 1 shows a laminate collapsible dispensing tube of this invention designated generally by the numeral 10. The tube 10 consists of a plastic headpiece 26, which may be preformed or injection molded onto the tube body, including a dispensing orifice 18 (shown in FIG. 3) and threads 17 for engaging a conventional closure cap (not shown). Extending from the headpiece 26 is the tube body 11. The tube body 11 is formed of a laminate material, as shown in cross section in FIG. 2, formed into a cylindrical body by wrapping the material through a single revolution whereupon it is joined at a longitudinal seam in the overlapped region between the opposite edges 15 and 16 of the laminate material. A transverse bottom seam 27 is formed in the tube body 11 by any of the conventional means known in the art.

Figure 2:
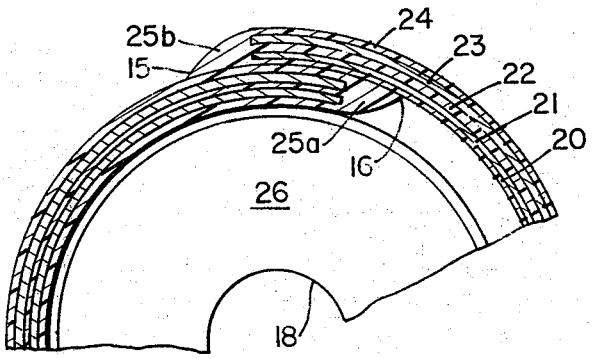
FIG. 2 is a cross-sectional view of the laminate comprising the tube of FIG. 1 taken along the line 2—2.

FIG. 2 is a cross section of the collapsible tube 10 of FIG. 1 showing the laminate material which comprises the tube body 11. The tube body 11 consists of an inner layer 20 which is a polymer selected for its compatibility with the contents of the collapsible tube and may be, for example, polyethylene (PE), copolymers of ethylene with vinyl acetate (EVA) or acrylic acid (EAA), or an ionomer such as that manufactured by E. I. duPont de Nemours & Co. and sold under the trademark "Surlyn". Other such materials known in the art may also be used. Bonded to the interior polymer layer 20 is a first layer of metallic foil 21, which is preferably a commercial grade of aluminum foil annealed to a "deadsoft" condition. A second layer of polymer 22 is bonded to the first layer of metallic foil 21 and also to a second layer of metallic foil 23 which is also preferably deadsoft aluminum. An outer layer of polymer 24 is preferably but optionally added to the structure as an exterior layer over the second layer of metallic foil.

Preferably, the laminate is supplied as a finished material so that forming the collapsible tube 10 is simply a matter of wrapping the laminate through a single turn (as shown in FIG. 2), forming the longitudinal seam and attaching the laminate to a headpiece 26 (either before or after but preferably after forming the longitudinal seam). The tube is filled through its open bottom; i.e., the end opposite the headpiece 26, prior to the forming of the transverse seam 27.

FIG. 2 shows one form of longitudinal seam suitable for use with the tube of the invention. The ends 15 and 16 of the laminate are brought into slightly overlapping relationship and heat sealed together. In this heat sealing process a portion of the interior and exterior polymer layers flows to form fillet regions 25*a* and 25*b* in the interior and exterior of the tube, respectively, thereby covering the otherwise exposed ends of the metallic layers 21 and 23 to prevent contact thereof with the product in the tube.

Figure 3:
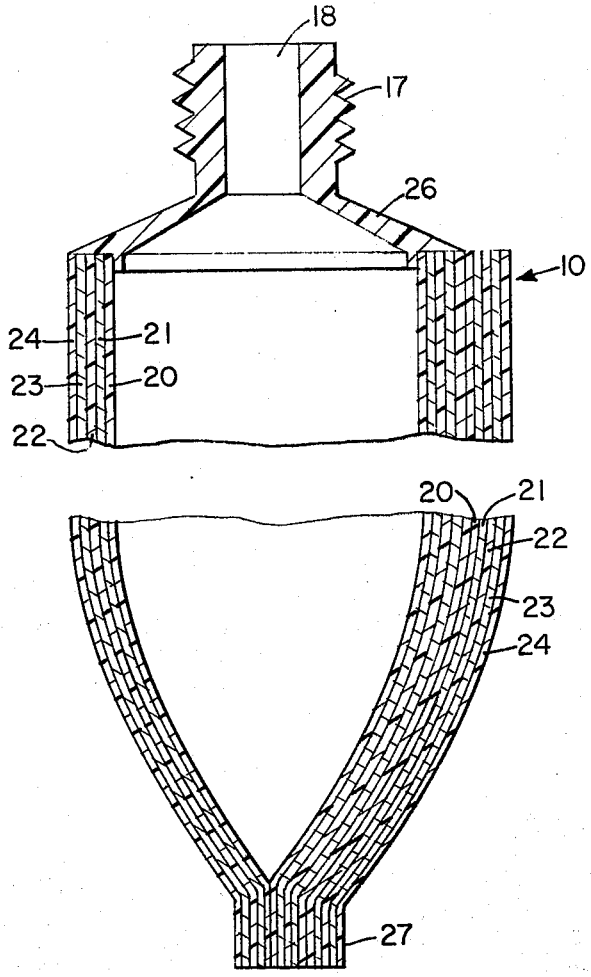
FIG. 3 is a vertical cross-sectional view of the tube of FIG. 1 taken along the line 3—3.

FIG. 3 is a cross section of the tube 10 taken along the line 3—3 in FIG. 1. This view shows the structure of the headpiece 26 including the dispensing orifice 18 contained therein.

As mentioned previously, it has been discovered that certain dimensional relationships within the laminate comprising the body 11 of the collapsible dispensing tube 10 determine the body and deadfold of such a tube.

Specifically, it has been discovered that the thickness of the inner layer of metallic foil 21 and the second layer of metallic foil 23 and the thickness of the layer of polymer 22 between them essentially determines the body of the tube 10. While there is no wish to be bound by any theory of operation of the invention, it is believed that the two layers of metallic foil and the interposed layer of polymer act in the manner of a composite beam (the foil layers corresponding to the flanges and the polymer between them serving as the web) if solidly bonded together. The polymer layer or layers outside the foil layers have relatively little effect on the beam strength of the structure.

To establish numeric values for the body of the tube a test procedure was set up in which an "Ohio" score bend tester, as manufactured by Paper Industry Instruments Inc., Cleveland, Ohio, and designated Model 202-I, commonly used for measuring the bending resistance of paperboard boxes, was modified to test laminate materials used in the present tube construction. A special adaptor was made so that the laminate could be folded through 90° from an initial "L" shape to the point at which the laminate was folded double on itself by the score bend tester. The laminate samples were uniformly folded by hand into the initial "L" shape by forming with the aid of a rigid angle member. The score bend values described below are the number of inch grams of torque (peak) required to fold a sample of the laminate 1-½ inches long along the fold. The results of these tests correlated closely with ratings of body given by panelists rolling up tubes made of certain of the laminate materials tested; i.e. the score bend test on a laminate sheet is an appropriate measure of the body of a tube made from it.

A large number of such laminates were tested for body on the score bend tester. The results were subjected to a multiple regression analysis, as described in Mathematical Methods for Digital Computers edited by Anthony Ralston and Herbert S. Wilf, Chapter 17, John Wiley & Sons Inc., 1960, to yield the best linear empirical equation describing body. The familiar "least squares" criterion was used for determining the best empirical equation.

Figure 5:
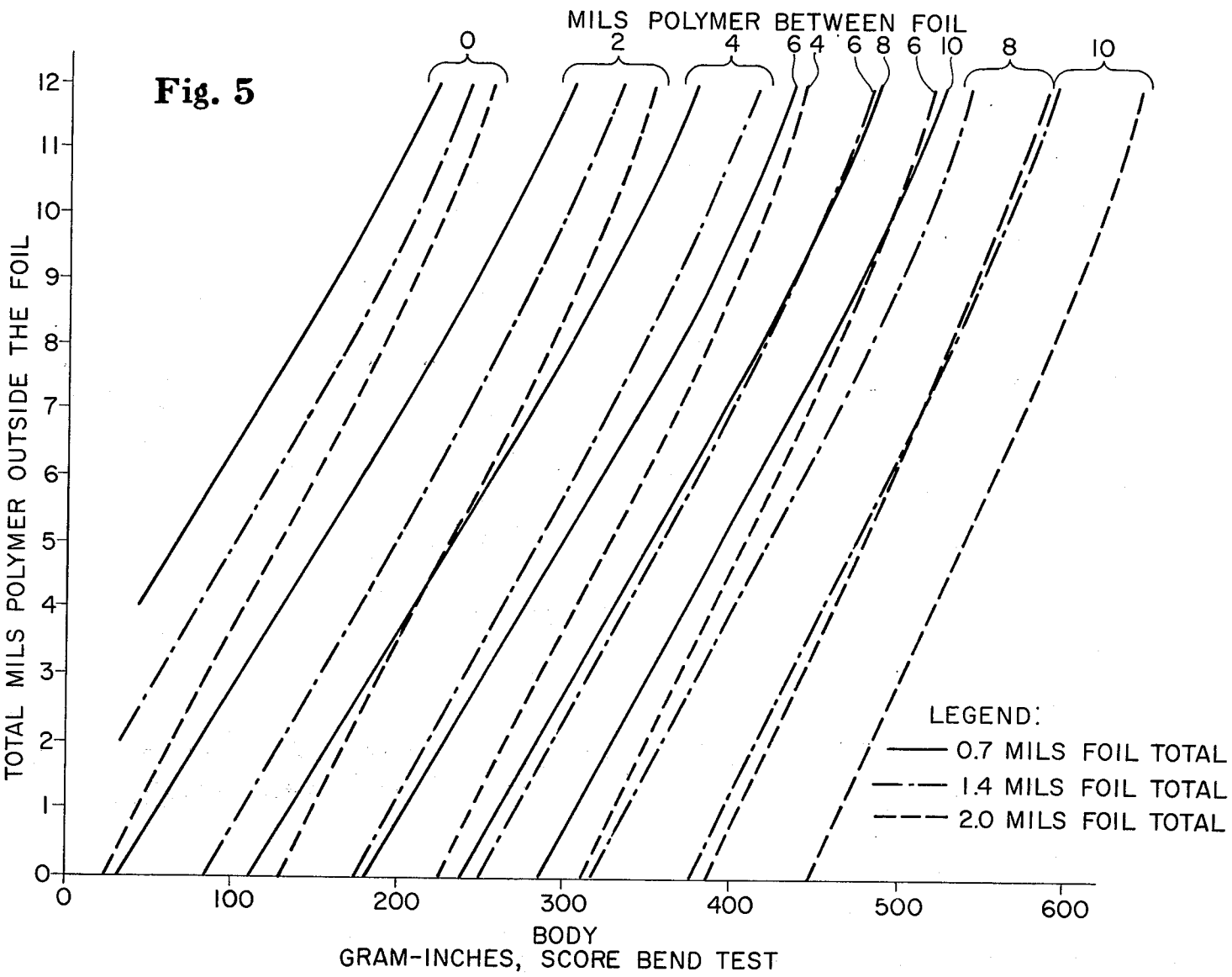
FIG. 5 is a graph showing the effects on tube body of varying the dimensions of the layers in the laminates comprising tubes of this invention.

FIG. 5 is a graph generated from the empirical equation determined by the regression analysis and shows the variations in body of several laminates suitable for use in tubes of this invention with variations in the total thickness of the two layers of metallic foil 21 and 23, the layer of polymer 22 between them, and the total of the layers of polymer 20 and 24 outside them. The two layers of foil in the structure tested were of equal thickness. As can be seen, the thickness of the layers of polymer outside the metallic foil has somewhat less effect on the body of the tube than does the thickness of the layers of metallic foil and the thickness of the layer of polymer between them.

As a point of reference conventional lead tube materials of the type associated with dispensing toothpaste and the like have a score bend value by this test of about 200 inch grams to about 350 inch grams. Since the samples used in testing score bend are 1-½ inches along the fold line, this may also be expressed as about 133 inch grams per inch to about 233 inch grams per inch.

It has further been discovered that only the polymer outside the layers of metallic foil has a significant effect on the deadfold of the laminate tube of this invention and that the outside layer of polymer 24 has a greater effect on deadfold than the inner layer of polymer 20. This is a surprising result for which there appears to be no simple explanation. Fortuitiously the center layer of polymer 22 of the laminate (which contributes significantly to its body as discussed earlier) has little or no effect on the deadfold of the tube, thereby allowing essentially separate determination of these two properties in the structure of this invention.

Figure 4A:
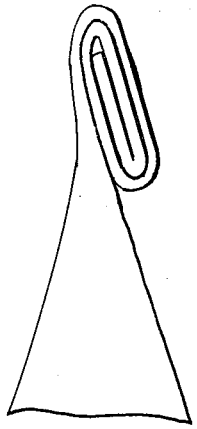
FIGS. 4*a* through *g* are schematic representation of elevation views of a series of laminated tubes illustrating the basis for assigning deadfold grades.
Figure 4B:
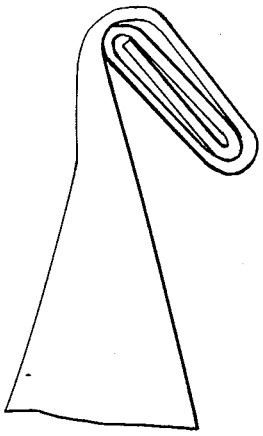
Figure 4C:
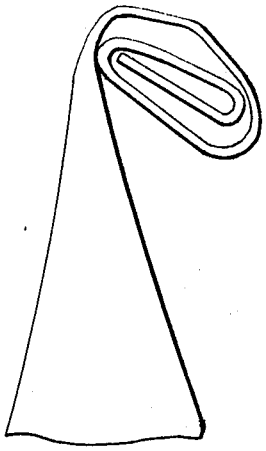
Figure 4D:
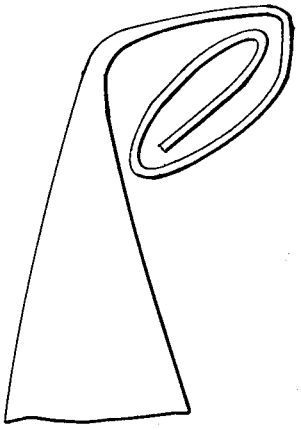
Figure 4E:
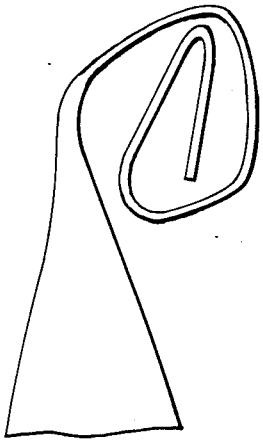
Figure 4F:
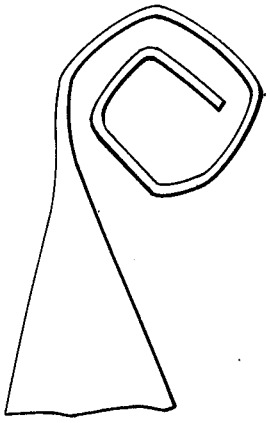
Figure 4G:
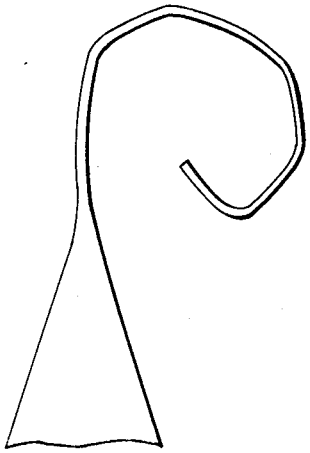

A number of tubes were constructed as described in Table I. The unfilled tubes were folded by hand through 180° four (4) times, placing the tube in the position as shown in FIG. 4*a*, to simulate dispensing the contents from the tube. Each tube was then released and allowed to unfold. Various tubes, depending on the laminate from which the tube body was made, unfolded to various points and the tube conditions shown in FIG. 4 were arbitrarily selected to provide a grading reference against which all of the tubes were measured for deadfold, i.e. the tendency not to unfold. As can be seen a deadfold grade of 0 indicates a tube which does no unfolding while a grade of 6 indicates a tube which unfolds to a large degree. In grading the tubes as shown in Table 1, interpolations were occasionally made between two deadfold grades resulting in the assignment of non-integral deadfold values for some tubes. A limited amount of testing has indicated that the deadfold properties of an unfilled tube correlate with the deadfold properties of a filled tube, thus allowing this simpler testing with unfilled tubes to be used to evaluate the deadfold properties of filled tubes.

The results of the grading are shown in Table 1. Tubes with a deadfold grade greater than 2 are excessively springy and make handling awkward and make discharging product, particularly the last product, from the tube difficult. The tube configurations tested and tabulated herein for deadfold utilized, except as noted, a copolymer of ethylene and acrylic acid as the polymer layers 20, 22 and 24 and deadsoft aluminum as layers 21 and 23; however a limited amount of testing has indicated that similar results will be obtained with other polymers and copolymers such as polyethylene commonly used in collapsible dispensing tubes.

TABLE 1

| Laminate Layer Thickness-Mils (See FIG. 2) | | | | | Deadfold |
|---|---|---|---|---|---|
| 20 | 21 | 22 | 23 | 24 | |
| 2 | .35 | 6 | .35 | 2 | 0 |
| 4 | .35 | 6 | .35 | 4 | 4 |
| 2 | .35 | 6 | .35 | 6 | 5 |
| 6 | .35 | 6 | .35 | 2 | 3 |
| 6 | .35 | 6 | .35 | 6 | 6 |
| 2 | .35 | 4 | .35 | 2 | 0 |
| 4 | .35 | 4 | .35 | 4 | 4.5 |
| 2 | .35 | 4 | .35 | 6 | 6 |
| 6 | .35 | 4 | .35 | 2 | 2 |
| 6 | .35 | 4 | .35 | 6 | 6 |
| 2 | .35 | 2 | .35 | 2 | 0 |
| 4 | .35 | 2 | .35 | 4 | 5 |
| 2 | .35 | 2 | .35 | 6 | 5 |
| 6 | .35 | 2 | .35 | 2 | 4 |
| 6 | .35 | 2 | .35 | 6 | 6 |
| 2 | .35 | 0 | .35 | 2 | 1 |
| 4 | .35 | 0 | .35 | 4 | 5 |
| 2 | .35 | 0 | .35 | 6 | 6 |
| 6 | .35 | 0 | .35 | 2 | 4 |
| 6 | .35 | 0 | .35 | 6 | 6 |
| 2 | 1 | 6 | 1 | 2 | 0 |
| 4 | 1 | 6 | 1 | 2 | .3 |
| 4 | 1 | 6 | 1 | 4 | 3 |
| 2 | 1 | 6 | 1 | 6 | 2 |
| 6 | 1 | 6 | 1 | 2 | 3 |
| 6 | 1 | 6 | 1 | 6 | 4 |
| 2 | 1 | 4 | 1 | 2 | 0 |
| 4 | 1 | 4 | 1 | 4 | 2.5 |
| 2 | 1 | 4 | 1 | 6 | 3 |
| 6 | 1 | 4 | 1 | 2 | 2 |
| 6 | 1 | 4 | 1 | 6 | 4 |
| 2 | 1 | 2 | 1 | 2 | 0 |
| 4 | 1 | 2 | 1 | 4 | 3.5 |
| 2 | 1 | 2 | 1 | 6 | 2 |
| 6 | 1 | 2 | 1 | 2 | 3 |
| 6 | 1 | 2 | 1 | 6 | 4 |
| 2 | 1 | 0 | 1 | 2 | 0 |
| 4 | 1 | 0 | 1 | 4 | 3 |
| 2 | 1 | 0 | 1 | 6 | 3.5 |
| 6 | 1 | 0 | 1 | 2 | 2 |
| 6 | 1 | 0 | 1 | 6 | 4.5 |
| 2 | 1.7 | 0 | 1.7 | 2 | 0 |
| 2 | 1.7 | 0 | 1.7 | 4 | 1 |
| 2 | 1.7 | 0 | 1.7 | 6 | 3.5 |
| 4 | 1.7 | 0 | 1.7 | 2 | 1 |
| 4 | 1.7 | 0 | 1.7 | 4 | 1 |
| 4 | 1.7 | 0 | 1.7 | 6 | 4 |
| 6 | 1.7 | 0 | 1.7 | 2 | 1 |
| 6 | 1.7 | 0 | 1.7 | 4 | 3 |
| 6 | 1.7 | 0 | 1.7 | 6 | 4 |
| 3 | .35 | 4 | .35 | 2 | .5 |
| 4 | 1 | 6 | 1 | 2 | .3 |
| 3 | .35 | 4 | .35 | 2 | .5 |

TABLE 1-continued

| Laminate Layer Thickness-Mils (See FIG. 2) | | | | | Deadfold |
|---|---|---|---|---|---|
| 20 | 21 | 22 | 23 | 24 | |
| 2 | 1 | 7.1 | 1 | 1.1* | .5 |
| 1.5 | .35 | 3.7 | .35 | 1** | 1 |
| 2 | .7 | 5 | .7 | 3*** | .5 |
| 2 | .7 | 3 | .7 | 3**** | .5 |

*Layers 20, 22 and 24 PE
**Layers 20 and 24 PE, layer 22 EVA
***Layer 20 1 mil PE bonded to layer 21 by 1 mil of EAA
Layer 22 3 mils PE between two (2) bonding 1 mil layers of EAA
Layer 24 2 mils PE bonded to layer 23 by 1 mil of EAA
****Layer 20 1 mil PE bonded to layer 21 by 1 mil of EAA
Layer 22 1 mil PE between two (2) bonding 1 mil layers of EAA
Layer 24 2 mils PE bonded to layer 23 by 1 mil of EAA Since the deadfold grades are visually assigned in reference to the grading table of FIG. 4, a certain amount of experimental/visual error is to be expected in this data. A "least squares multiple regression analysis" of the above data has resulted in an empirical equation for deadfold of:

1. Deadfold grade $= -0.71 + 0.45$ (thickness of layer 20 in mils) $+ 0.78$ (thickness of layer 24 in mils) $-0.74$ (total thickness of foil layers 21 and 23 in mils).

Figure 6:
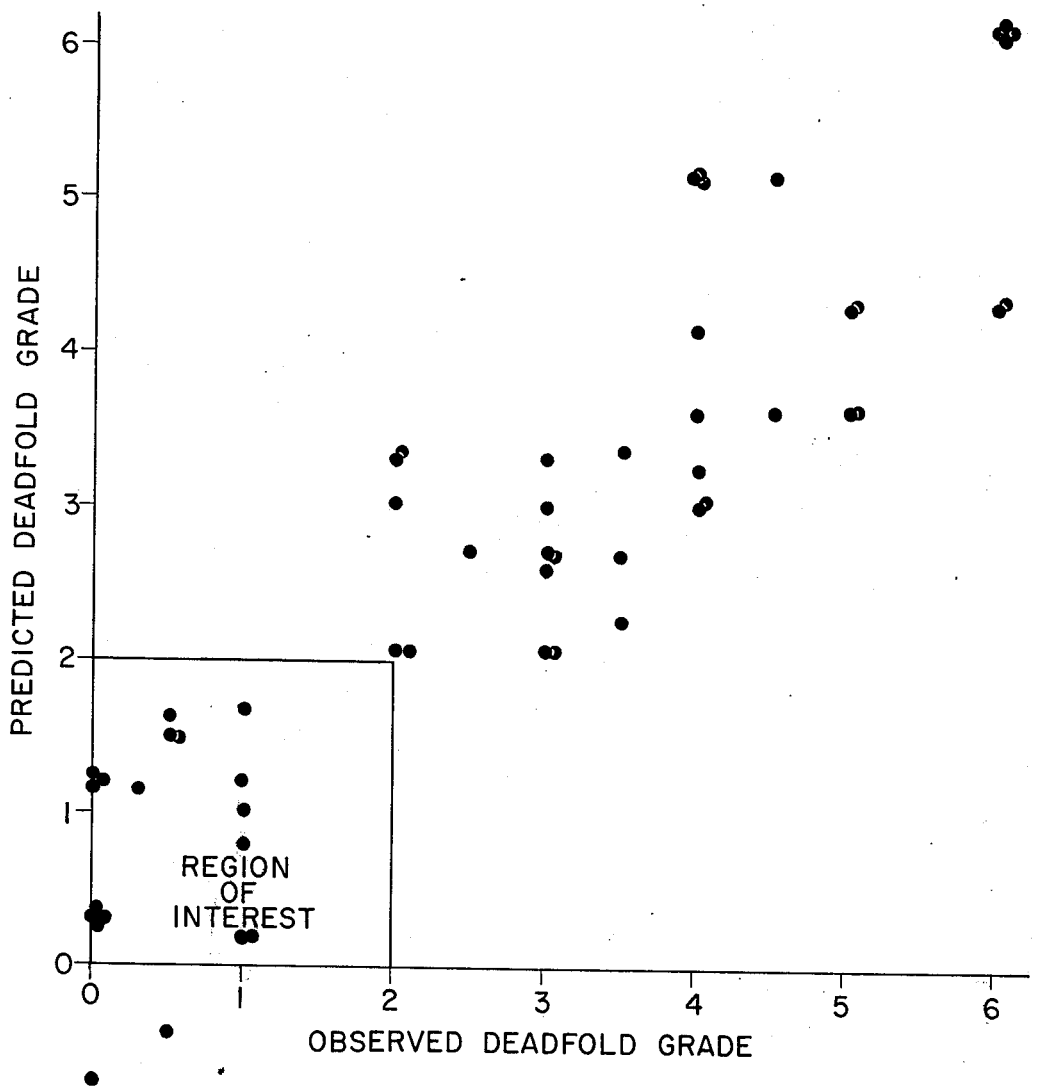
FIG. 6 is a graph showing predicted deadfold grades vs. observed deadfold grades.

FIG. 6 shows the values for deadfold grade predicted from the above equation plotted vs. the observed deadfold grades from Table 1. It can be seen that the predictions based on the empirical equation correlate well with the observed data although the experimental results, by the nature of the test, contain some "wobble"; i.e., random variation about the predicted values. Most importantly, it can be seen that in all cases structures are desirable or undesirable as predicted by the empirical equation; i.e., each tube predicted to have a deadfold grade of less than 2 (desirable) was in the desirable range and vice versa.

As mentioned previously, desirable tubes have a deadfold grade equal to or preferably less than 2. Inserting this condition into the above equation, tubes with desirable deadfold may be defined as satisfying the following inequality:

2. 0.45 (thickness of layer 20 in mils) $+ 0.78$ (thickness of layer 24 in mils) $- 0.74$ (thickness of foil layers 21 plus 23 in mils $\leq 2.71$.

Taken together, FIG. 5 and equation (2) allow designing a laminate collapsible dispensing tube with both desirable body and deadfold properties. The unique ability of tubes of this invention to provide both desirable body and deadfold can best be appreciated by recognizing the relationship of the center layer of polymer 22 to each of these properties. As shown in FIG. 5 the body of a tube of this invention may be widely varied by varying the thickness of the layer 22. In contrast, the deadfold of a tube of this invention, as shown by equations (1) and (2) is not a function of the thickness of the layer 22. The independence of deadfold of the thickness of layer 22 may also be appreciated by reference to Table 1.

The structure of this invention offers advantages in addition to the ability to adjust deadfold and body more or less independently.

The amount of the relatively expensive metallic foil required to achieve the desired tube body is substantially reduced by the use of two layers of foil separated by a layer of polymer. This effect is well demonstrated by FIG. 5.

In addition unequal thickness of metallic foil may be used as the two layers 21 and 23. This may be of practical importance because of the way in which a tube is assembled. For example, the outside of the outer layer of metallic foil 23 may have printing on it while the outer layer of polymer 24, may be clear, allowing viewing of the printing through it. If this is the case, the metallic foil 23 is printed before being assembled into the laminate which forms the tube body 11. It is well known that the printing operation results in substantial amounts of scrap, sometimes as much as 30%. Thus it is decidedly advantageous to use a thin layer of metallic foil 23, thereby reducing the absolute amount of metallic foil which becomes scrap as a result of the printing operation.

Since each of the four or five layers comprising the tube body 11 is independent of the other layers, each layer may be made of materials uniquely suited to its location. For example, the inner layer of polymer 20 can be of a material with low absorptivity of materials contained within the tube thus minimizing the amount of flavor or active ingredient absorbed into layer 20 and therefore not available to the consumer.

Additionally, the exterior layer of polymer 24 may be one especially suited for use as the exterior of a collapsible dispensing tube, for example the polyesterurethane compound described in U.S. Pat. No. 3,441,057 issued April 29, 1969 to Finn Clement et al, and commonly owned by the assignee of this invention.

Also, it should be understood that any of the layers of polymer 20, 22 and 24 may themselves be composites and/or may be joined to one another by adhesives while still achieving the advantages of this invention. For instance a copolymer of ethylene and acrylic acid may be used as an adhesive layer to bond polyethylene to either of the layers of metallic foil 21 and 23.

Many modifications of the invention can be made and it is not intended to limit the invention to the particular structures described, all reasonable equivalents thereof being intended to fall within the scope of the invention.

What is claimed is:

1. A collapsible dispensing tube including a headpiece having a dispensing orifice therein and a body extending from said headpiece, said body comprising a single layer of a laminated material, said laminated material comprising an inner layer of polymer, a first layer of metallic foil annealed to a substantially deadsoft condition superposed thereon and bonded thereover, a second layer of polymer superposed on said first layer of metallic foil and bonded thereover, and a second layer of metallic foil annealed to a substantially deadsoft condition superposed over said second layer of polymer and bonded thereover, said laminated material being in tubular form and having the longitudinal edges thereof in contiguous relationship and sealed into a longitudinal seam.

2. The collapsible dispensing tube of claim 1 wherein said first and said second layers of polymers are composites comprising a layer of polyethylene and a layer of a copolymer of ethylene and acrylic acid interposed between said polyethylene layers and said layers of foil, said copolymer being an adhesive bonding said polyethylene to said foil.

3. The collapsible dispending tube of claim 1 wherein said first and said second layers of foil are of different thicknesses.

4. A collapsible dispensing tube including a headpiece having a dispending orifice therein and a body extending from said headpiece, said body comprising a single layer of a laminated material, said laminated material comprising an inner layer of polymer, a first layer of metallic foil superposed thereover, and bonded thereto, a second layer of polymer superposed on said first layer of metallic foil and bonded thereto, a second layer of metallic foil superposed over said second layer of polymer and bonded thereto, and a third layer of polymer superposed over and bonded to said second layer of metallic foil, wherein 0.45 times the thickness of said inner layer of polymer in mils + 0.78 times the thickness of said third layer of polymer in mils − 0.74 times the total thickness of said first and second layers of metallic foil in mils is less than or equal 2.71, said laminated material being in tubular form and having the longitudinal edges thereof in contiguous relationship and sealed into a longitudinal seam.

5. The collapsible dispensing tube of claim 4 wherein the laminate forming said tube has a score bend value of from about 133 inch grams per inch to about 233 inch grams per inch.

6. The collapsible dispensing tube of claim 4 wherein said first, second and third layers of polymer are composites comprising polyethylene and a layer of a copolymer of ethylene and acrylic acid interposed between said polyethylene layers and said layers of foil said copolymer being an adhesive and bonding said polyethylene to said foil.

7. The collapsible dispensing tube of claim 6 wherein said first layer of polymer is two mils of polyethylene bonded to said first layer of metallic foil by one mil of a copolymer of ethylene and acrylic acid, said second layer of polymer is one mil of polyethylene bonded to said first and second layers of metallic foil by one mil of a copolymer of ethylene and acrylic acid, said third layer of polymer is one mil of polyethylene bonded to said second layer of metallic foil by one mil of a copolymer of ethylene and acrylic acid, and said first and second layers of metallic foil are 0.7 mils of deadsoft aluminum.

8. A collapsible dispending tube including a headpiece having a dispensing orifice therein and a body extending from said headpiece, said body comprising a single layer of a laminated material, said laminated material comprising a pair of layers of metallic foil, spacing means interposed between said pair of layers of metallic foil for maintaining them in spaced apart relationship and providing therewith selectable body characteristics for the tube and comprising, in turn, a layer of polymer laminated between said layers 4 metallic foil and solidly bonded thereto, and lining means extending across the inner surface of the inner one of said pair of layers of metallic foil for preventing contact thereof with product disposed within the tube and providing therewith selectable deadfold characteristics substantially independently of the body characteristics and comprising, in turn, a layer of polymer laminated to the inner surface of said inner one of said pair of layers of metallic foil and solidly bonded thereto, said laminated material being in tubular form and having the longitudinal edges thereof in contiguous relationship and sealed into a longitudinal seam.

9. Collapsible dispending tube defined in claim 8 wherein each of said layers of metallic foil comprise aluminum foil annealed to a substantially deadsoft condition.

10. Collapsible dispensing tube defined in claim 8 further comprising means extending across the outer surface of the outer one of said layers of metallic foil for enabling heat sealing thereof with said lining means upon overlapping thereof to form said longitudinal seam and comprising, in turn, a layer of polymer laminated thereacross.

11. A collapsible dispensing tube including a headpiece having a dispensing orifice therein and a body extending from said headpiece, said body comprising a single layer of a laminated material, said laminated material comprising a pair of layers of metallic foil, spacing means interposed between said pair of layers of metallic foil for maintaining them in spaced apart relationship and providing therewith body characteristics for the tube dependent upon the relative thicknesses thereof and comprising, in turn, a layer of polymer laminated between said layers of metallic foil and solidly bonded thereto, and lining means extending across the inner surface of the inner one of said pair of layers of metallic foil for preventing contact thereof with product disposed within the tube and providing therewith deadfold characteristics dependent upon the relative thicknesses thereof and substantially independent of the body characteristics and comprising, in turn, a layer of polymer laminated to the inner surface of said inner one of said pair of layers of metallic foil and solidly bonded thereto, said laminated material being in tubular form and having the longitudinal edges thereof in contiguous relationship and sealed into a longitudinal seam.

12. Collapsible dispensing tube defined in claim 11 wherein each of said layers of metallic foil comprise aluminum foil annealed to a substantially deadsoft condition.

13. Collapsible dispensing tube defined in claim 11 further comprising means extending across the outer surface of the outer one of said layers of metallic foil for enabling heat sealing thereof with said lining means upon overlapping thereof to form said longitudinal seam and comprising, in turn, a layer of polymer laminated thereacross.

14. A collapsible dispensing tube comprising a headpiece having a dispensing orifice therein and a collapsible generally tubular body extending therefrom said tubular body comprising a single turn of laminated material and a generally longitudinally extending lap seam, said laminated material comprising means for providing body characteristics to the tube substantially independent of the deadfold characteristics and meams for providing deadfold characteristics to the tube substantially independent of the body characteristics.

15. A collapsible dispensing tube comprising a headpiece having a dispensing orifice therein and a collapsible generally tubular body extending therefrom, said tubular body comprising a single turn of laminated material and a generally longitudinally extending lap seam, said laminated material comprising means for providing body characteristics to the tube which are variable and which may be selected substantially independent of the selected deadfold characteristics and means for providing deadfold characteristics to the tube which are variable and which may be selected substantially independent of the selected body characteristics.

* * * * *